US012742605B2

(12) United States Patent
Wolf et al.

(10) Patent No.: US 12,742,605 B2
(45) **Date of Patent: *Sep. 22, 2026**

(54) MODULAR HANDGUN

(71) Applicant: ZEV Technologies LLC, Oxnard, CA (US)

(72) Inventors: Alec Daniel Wolf, Westlake Village, CA (US); Gene Anthony Velasquez, Fort Lauderdale, FL (US)

(73) Assignee: ZEV Technologies, LLC, Riverton, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/025,797

(22) Filed: Jan. 16, 2025

(65) Prior Publication Data

US 2025/0251207 A1 Aug. 7, 2025

Related U.S. Application Data

(60) Continuation of application No. 18/063,215, filed on Dec. 8, 2022, now Pat. No. 12,287,164, which is a continuation of application No. 17/181,310, filed on Feb. 22, 2021, now Pat. No. 11,525,645, which is a continuation of application No. 16/152,604, filed on Oct. 5, 2018, now Pat. No. 10,955,209, which is a (Continued)

(51) Int. Cl.

| | |
|---|---|
| ***F41A 11/02*** | (2006.01) |
| ***F41A 19/15*** | (2006.01) |
| ***F41A 21/48*** | (2006.01) |
| ***F41C 23/10*** | (2006.01) |
| *F41C 3/00* | (2006.01) |

(52) U.S. Cl.

CPC ..... *F41A 11/02* (2013.01); *F41A 19/15* (2013.01); *F41A 21/488* (2013.01); *F41C 23/10* (2013.01); *F41C 3/00* (2013.01)

(58) Field of Classification Search

CPC ..... F41A 19/15; F41A 21/488; F41A 11/00; F41A 11/02; F41C 23/10; F41C 3/00

USPC ..... 42/71.01, 71.02, 72, 73, 75.01

See application file for complete search history.

(56) References Cited

U.S. PATENT DOCUMENTS 5,293,708 A * 3/1994 Strayer ..... F41C 23/10 42/71.02

5,669,169 A * 9/1997 Schmitter ..... F41A 3/66 89/196

(Continued)

FOREIGN PATENT DOCUMENTS

WO WO-9521366 A1 * 8/1995 ..... F41C 23/10

*Primary Examiner* — John Cooper

(74) *Attorney, Agent, or Firm* — Asgaard Patent Services, LLC; F. Wayne Thompson, Jr.

(57) ABSTRACT

A modular handgun system comprises an elongated universal trigger frame having a pair of slide rails and an accessory rail. The trigger frame is adapted to have a trigger assembly mounted thereto. The system further comprises a grip frame having an elongated channel and a hand grip extending downwardly from the elongated channel. The trigger frame is removably mounted in the elongated channel of the grip frame. The accessory rail of the trigger frame is positioned forward of a forward end of the elongated channel of the grip frame so as to be exposed. The system further comprises a slide and barrel assembly slidably mounted on the slide rails of the trigger frame.

20 Claims, 13 Drawing Sheets

Related U.S. Application Data division of application No. 15/434,933, filed on Feb. 16, 2017, now Pat. No. 10,119,777, which is a continuation-in-part of application No. 15/406,111, filed on Jan. 13, 2017, now abandoned.

(60) Provisional application No. 62/279,902, filed on Jan. 18, 2016.

(56) References Cited

U.S. PATENT DOCUMENTS

| | | | | |
|---|---|---|---|---|
| 6,234,059 | B1 * | 5/2001 | Fuchs | F41A 19/15 89/196 |
| 8,935,871 | B2 * | 1/2015 | Bardy | F41A 19/14 42/70.08 |
| 2002/0116857 | A1 * | 8/2002 | Wonisch | F41A 21/488 42/75.02 |
| 2008/0060247 | A1 * | 3/2008 | Thomele | F41A 3/66 42/71.02 |
| 2009/0071053 | A1 * | 3/2009 | Thomele | F41A 11/02 42/70.08 |

* cited by examiner

MODULAR HANDGUN

RELATED APPLICATIONS

This application is a continuation of U.S. patent application Ser. No. 18/063,215 filed Dec. 8, 2022, which is a continuation of U.S. patent application Ser. No. 17/181,310 filed Feb. 22, 2021, now U.S. Pat. No. 11,525,645, which is a continuation of U.S. patent application Ser. No. 16/152,604 filed Oct. 5, 2018, now U.S. Pat. No. 10,995,209, which is a divisional of U.S. patent application Ser. No. 15/434,933 filed Feb. 16, 2017, now U.S. Pat. No. 10,119,777, which is a continuation-in-part of U.S. patent application Ser. No. 15/406,111 filed Jan. 13, 2017, which claims priority to U.S. Provisional Patent Application No. 62/279,902 filed Jan. 18, 2016, all of which are hereby incorporated by reference herein as if fully set forth in their entirety.

FIELD OF THE INVENTION

The present invention relates to improvements in handgun design and manufacturing. More particularly, it provides a modular construction with structural benefits and adaptability for particular users and uses.

BACKGROUND OF THE INVENTION

The use of high strength polymers to construct structural components of a handgun, such as the grip frame, have been known for some time. In some examples, such as various models of the popular GLOCK® handgun, certain parts made of metal are embedded in a polymer frame as it is injection molded. In other examples, a polymer grip frame is used with removably attachable metal components, or has metal frame parts that are separable from a polymer grip frame or grip component.

While the use of polymer materials for structural parts in a handgun are very effective at reducing its weight, the polymer materials flex or fatigue at rates different from the metal components that are inserted or embedded in the polymer. As a result, particularly over extended time and use, critical spacing dimensions, such as between pivot points of parts in the action that work together, may change, increasing the possibility of a failure.

Flat surfaces that slide over each other in a mechanical assembly, such as a firearm, may fit very closely. Oil-type lubricants can be effective on these sliding surfaces for a limited time, or until metal filings or other particulate debris accumulates in the tight clearance. Captured in place, these particles can caused increased wear, galling, and even seizing of the parts.

SUMMARY OF THE INVENTION

In one aspect, a modular handgun system is provided. The system comprises an elongated universal trigger frame having a pair of slide rails. The trigger frame is adapted to have a trigger assembly mounted thereto. The system further comprises a grip frame having an elongated channel, a hand grip extending downwardly from the elongated channel, and a trigger guard extending between the elongated channel and the hand grip. The trigger frame is removably mounted in the elongated channel of the grip frame. The system further comprises a slide and barrel assembly slidably mounted on the slide rails of the trigger frame.

The handgun system can further include at least two grip frames and at least two slide and barrel assemblies. One of the two grip frames has a first hand grip length and the other of the two grip frames has a second hand grip length; the second hand grip length is longer than the first hand grip length. One of the two slide and barrel assemblies has a first slide and barrel length and the other of the two slide and barrel assemblies has a second slide and barrel length; the second slide and barrel length is longer than the first slide and barrel length.

The handgun system can further include at least first, second, third, and fourth grip frames and at least two slide and barrel assemblies. The first grip frame has a first hand grip length and a first hand grip circumference and the second grip frame has a second hand grip length and a second hand grip circumference; the second hand grip length is longer than the first hand grip length. The third grip frame has a third hand grip length and a third hand grip circumference and the fourth grip frame has a fourth hand grip length and a fourth hand grip circumference; the fourth hand grip circumference is greater than the third hand grip circumference. One of the two slide and barrel assemblies has a first slide and barrel length and the other of the two slide and barrel assemblies has a second slide and barrel length; the second slide and barrel length is longer than the first slide and barrel length.

The reward portion of the trigger frame can have a first rearward extension, the grip frame can have a first recess which receives the first rearward extension, and the trigger frame and the grip frame can have alignable openings. A pin can be removably inserted in the openings once aligned.

The rearward portion of the trigger frame can further have a second rearward extension spaced below the first rearward extension, and the grip frame can have a second recess which receives the second rearward extension. The second rearward extension can comprise a pair of transversely spaced apart rearward hooks.

The trigger frame and the grip frame can have cooperating ramp surfaces for camming the trigger frame rearwardly relative to the grip frame after the first rearward extension has been inserted into the first recess and as the trigger frame is pivoted downwardly into the channel of the grip frame.

The trigger frame can have an outwardly extending lug on each lateral side thereof and the channel of the grip frame has a notch in each lateral side thereof. Each lug is received in a respective one of the notches.

The slide rails can have upper surfaces and laterally outwardly extending side edges. The slide rails can include recesses in at least one of the upper surfaces and the laterally outwardly extending side edges. The slide rails can include recesses in both the upper surfaces and the laterally outwardly extending side edges. The recesses can be inlay recesses, diagonal, parallel groove recesses, or arcuate recesses, or combinations of inlay recesses, diagonal, parallel recesses, and arcuate recesses.

The trigger frame can be adapted to have a slide release lever mounted thereto and a slide takedown lever mounted thereto.

The trigger frame can be fabricated of a metallic material and the grip frame can be fabricated of a polymer material. The trigger frame is preferably a unitary structure with the pair of slide rails and the accessory rail being formed integrally therewith. For example, the trigger frame can be machined from a single billet of metallic material.

In another aspect, a universal trigger frame for a modular handgun system is provided. The universal trigger frame is adapted to be used with a plurality of grip frames and with a plurality of slide and barrel assemblies, wherein each of the plurality of grip frames has a different hand grip length and/or a different hand grip circumference and each of the slide and barrel assemblies has a different slide and barrel length. The universal trigger frame comprises an elongated frame having a pair of slide rails and an accessory rail. The frame is adapted to have a trigger assembly mounted thereto. The trigger frame further comprises an opening in the frame adapted to be aligned with an opening in the grip frame for removably receiving a pin.

In another aspect, a universal trigger frame for a modular handgun system is provided. The universal trigger frame is adapted to be used with a plurality of grip frames and with a plurality of slide and barrel assemblies, wherein each of the plurality of grip frames has a different hand grip length and/or a different hand grip circumference and each of the slide and barrel assemblies has a different slide and barrel length. The universal trigger frame comprises an elongated frame having a pair of slide rails and an accessory rail. The frame is adapted to have a trigger assembly mounted thereto. The trigger frame further comprises a first rearward extension adapted to be received in a first recess of the grip frame, a second rearward extension, spaced below the first rearward extension, and adapted to be received in a second recess in the grip frame, a ramp surface adapted to cooperate with a ramp surface on the grip frame for camming the frame rearwardly relative to the grip frame after the first rearward extension has been inserted into the first recess and as the frame is pivoted downwardly into the channel of the grip frame, an outwardly extending lug on each lateral side of the frame, each lug being adapted to be received in a respective notch in each lateral side of the channel of the grip frame, and an opening adapted to be aligned with an opening in the grip frame for removably receiving a pin.

In another aspect, a method of assembling a handgun is provided. The method comprises the steps of providing a grip frame having an elongated channel and a hand grip extending downwardly from the elongated channel, providing an elongated trigger frame having a pair of slide rails and an accessory rail, and providing a trigger assembly comprising a trigger and a trigger mechanism housing. The method further comprises positioning the trigger and the trigger mechanism housing in the trigger frame, pinning the trigger to the trigger frame with a trigger pin, pinning the trigger mechanism housing to the trigger frame with a trigger mechanism housing pin, positioning the trigger frame in the grip frame channel, and pinning the trigger frame to the grip frame with a trigger frame pin.

The method can further comprise providing a slide release lever, providing a slide takedown lever, and assembling the slide release lever and the slide takedown lever to the trigger frame prior to positioning the trigger frame in the grip frame channel.

In another aspect, a universal trigger module for a handgun is provided. The trigger module comprises an elongated unitary trigger frame having a pair of slide rails and an accessory rail, the pair of slide rails and accessory rail all formed integrally with the trigger frame, a trigger and a trigger mechanism housing removably secured to the trigger frame, a slide release lever removably secured to the trigger frame, and a slide takedown lever removably secured to the trigger frame.

The trigger frame can be adapted to be removably secured to a handgun grip frame with a fastener different than that used to secure the trigger, trigger mechanism housing, slide release lever, and said slide takedown lever to the trigger frame.

Various aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION OF THE INVENTION

Figure 1:
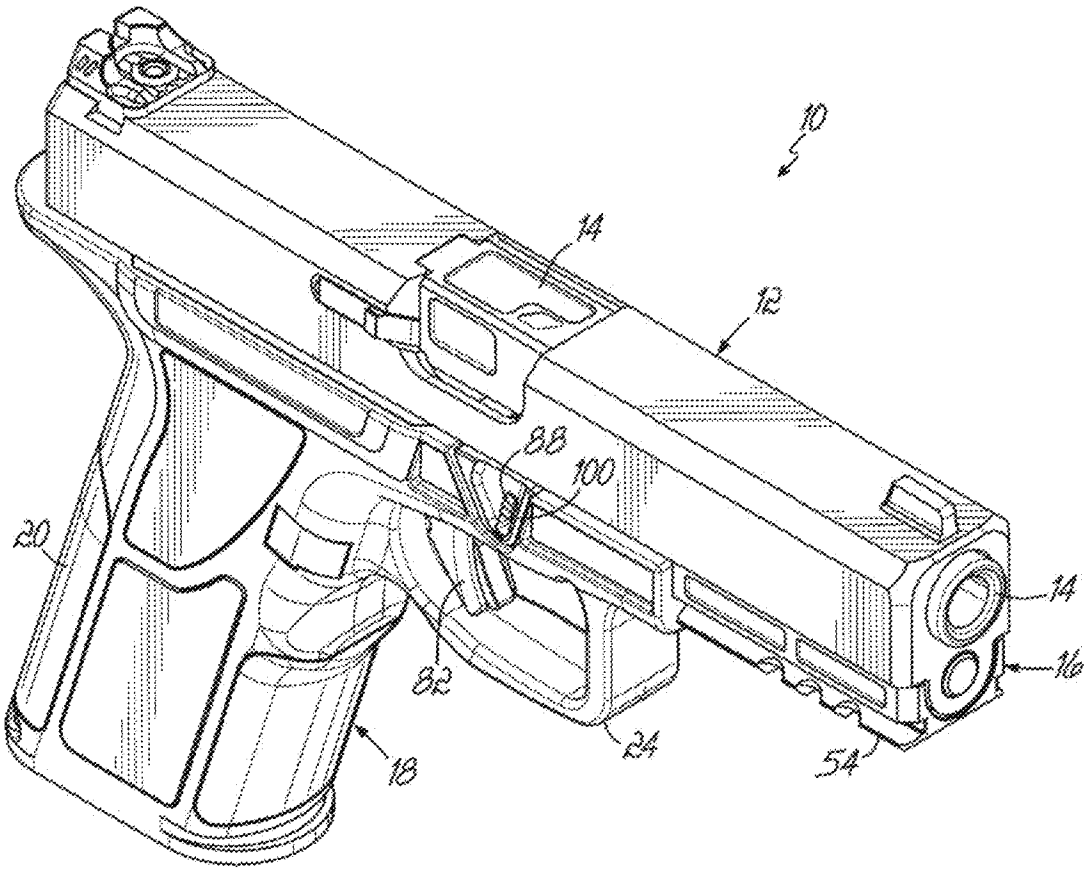
FIG. 1 is a front, right, top perspective view of a handgun according to one embodiment of the present invention.
Figure 2:
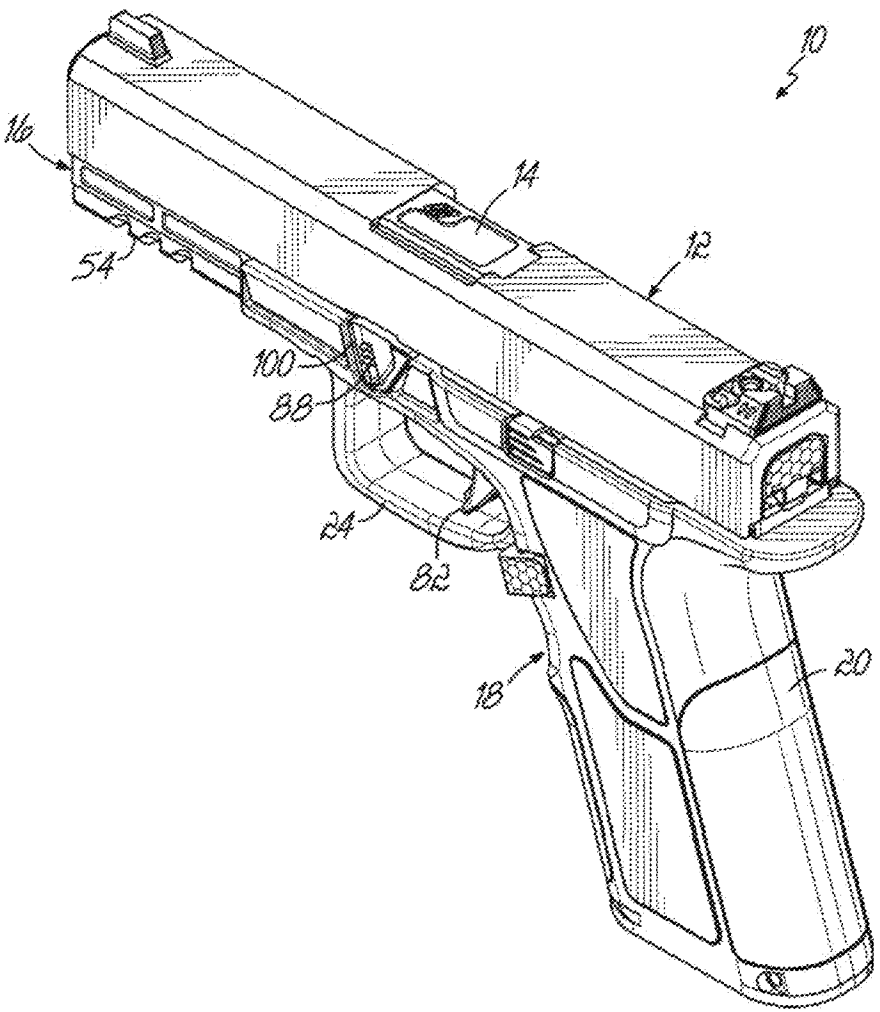
FIG. 2 is a rear, left, top perspective view thereof.
Figure 4:
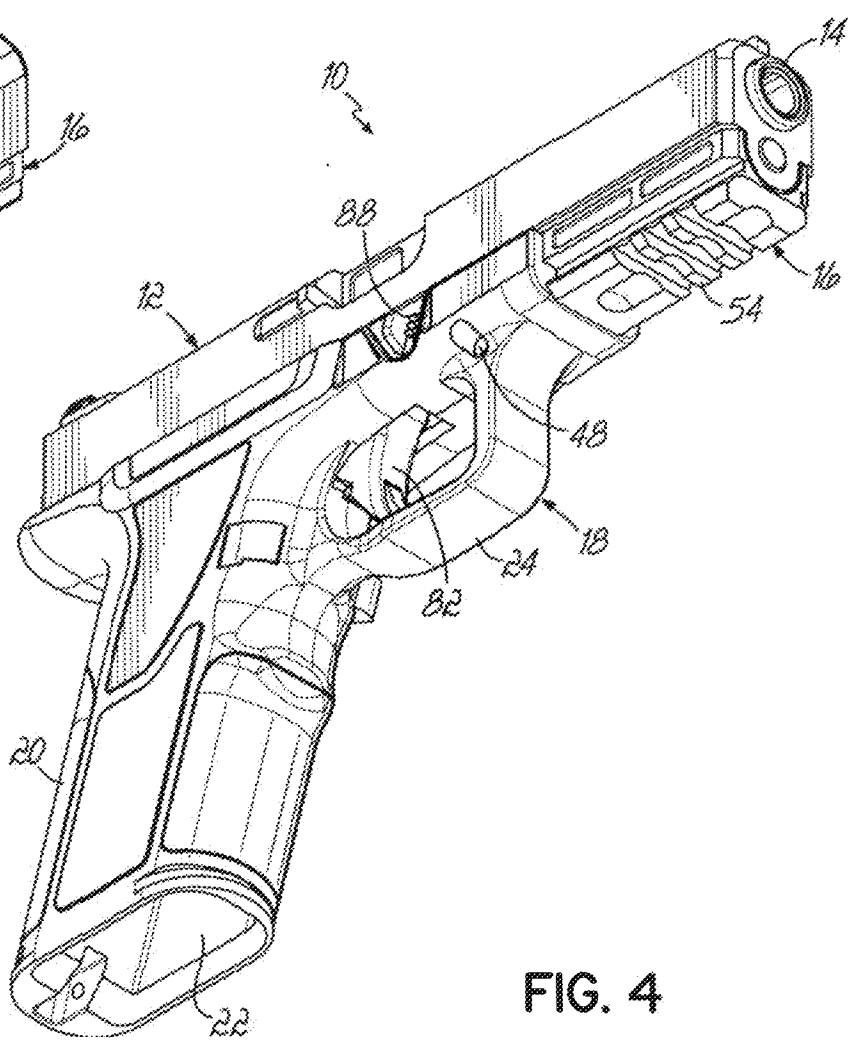
FIG. 4 is a front, right, bottom perspective view thereof.
Figure 3:
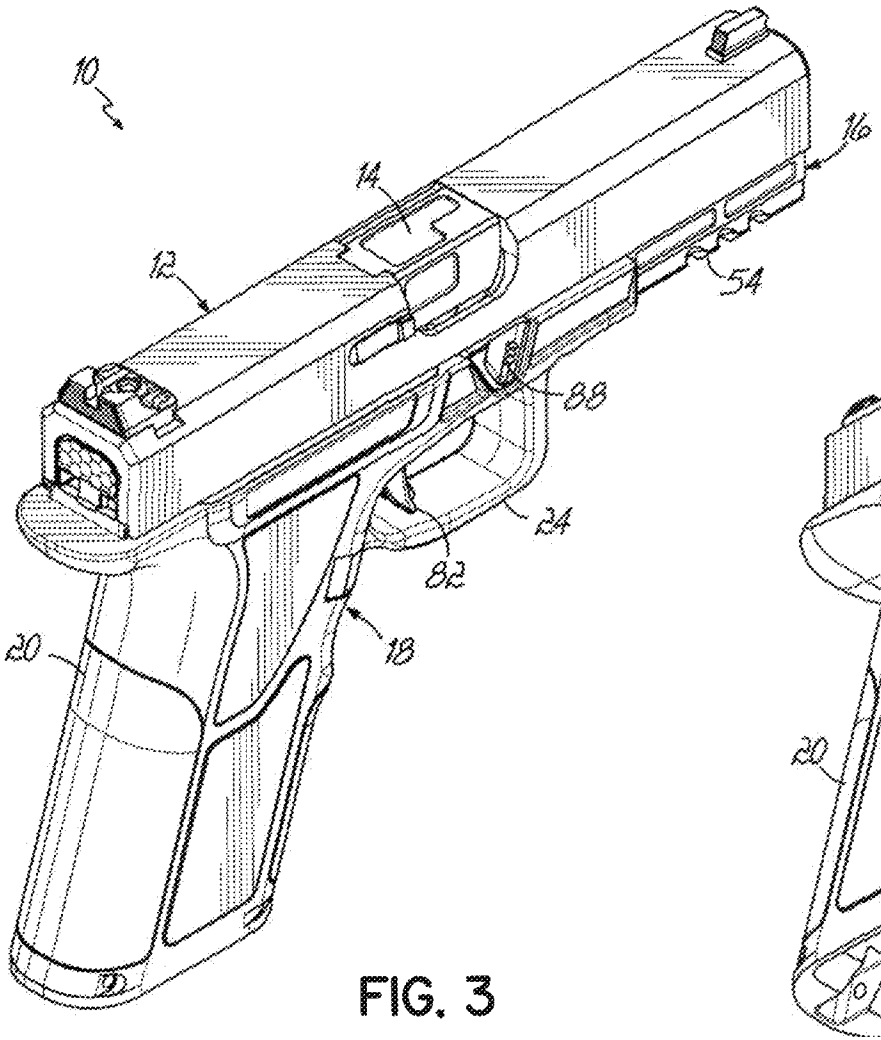
FIG. 3 is a rear, right, top perspective view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring now to the various figures of the drawings, and first to FIGS. 1-4, therein is shown at 10 a semiautomatic handgun according to one embodiment of the present invention. The handgun 10 generally comprises a slide 12 that carries a barrel 14 and longitudinally reciprocates on a frame component or trigger frame 16. The trigger frame 16 is mounted to a grip component or grip frame 18, which includes a hand grip 20, a magazine well 22, and a trigger guard 24. Other parts shown on these exterior views of the handgun 10 are not necessarily pertinent to the present invention. Detailed description and illustration of the slide, trigger mechanism, and some aspects of the barrel are not included. For the illustrated embodiment, these parts are functionally equivalent and/or interchangeable with such parts for a GLOCK® handgun or "clones" thereof.

Figure 5:
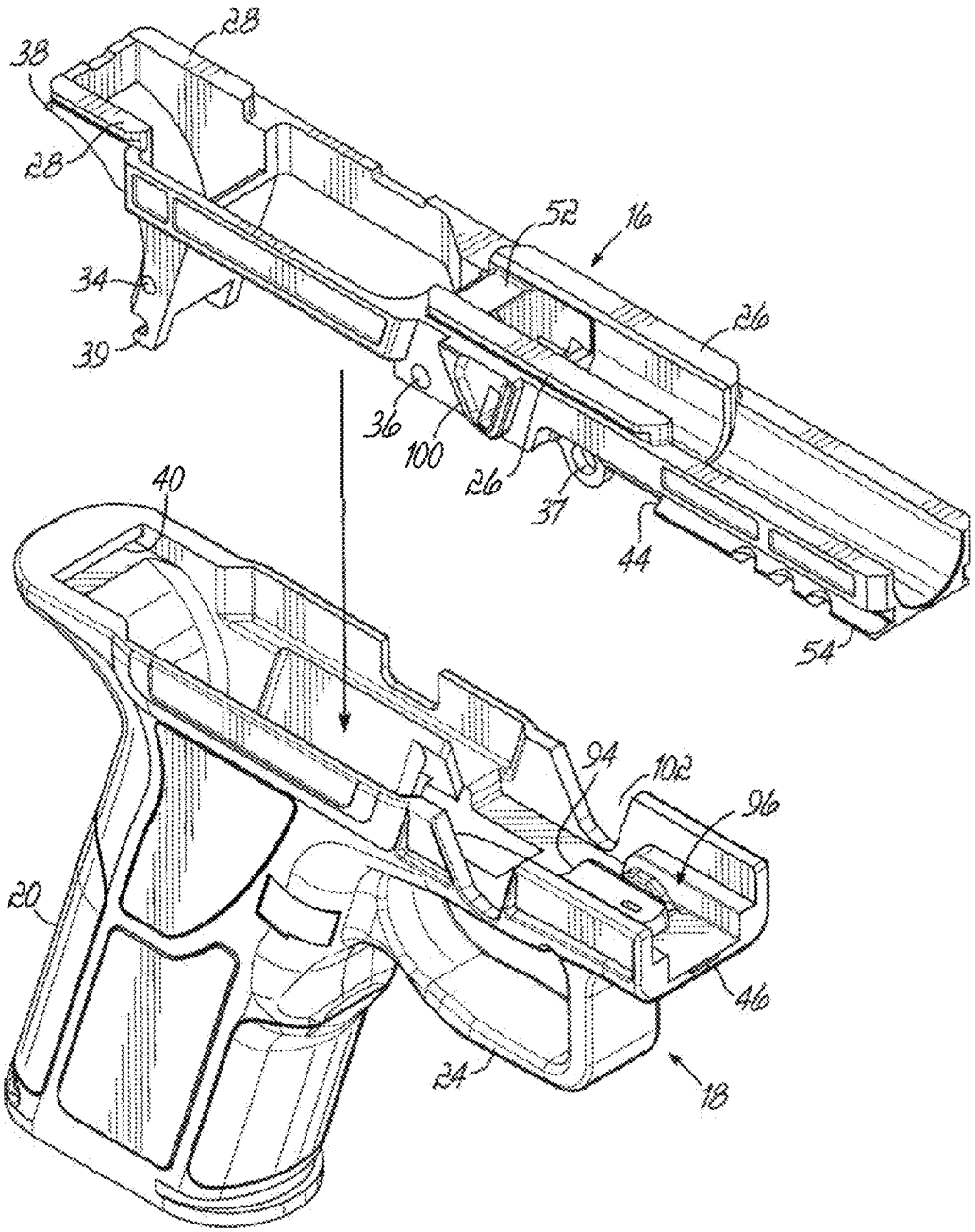
FIG. 5 is an exploded perspective view of a handgun grip frame and trigger frame according to one embodiment of the present invention.

Referring now to FIG. 5, therein are shown the frame component or trigger frame 16 and grip component or grip frame 18, otherwise stripped of other parts and disassembled from one another. The trigger frame 16 includes slide rails 26, 28 on which the slide 12 (not shown in FIG. 5) is mounted for longitudinal reciprocation during cycling of the semiautomatic action in a well-known manner. The grip frame 18 is configured to receive the trigger frame 16, which may be fixed in place in a novel manner described below using a single assembly pin that will extend through aligned mounting openings 35 in the grip frame 18 and mounting openings 37 in the trigger frame 16. Other internal assembly pins 49, 50 used to mount the trigger mechanism housing 80 and trigger 82, respectively, to the trigger frame 16 are held captive against transverse displacement when the trigger frame 16 is assembled to the grip frame 18, as the grip frame 18 does not include corresponding openings, as will become apparent below.

Referring now also to FIGS. 6A-6D and 7, according to one aspect of the invention, assembly of trigger assembly 78 to the trigger frame 16, and assembly of the trigger frame 16 to the grip frame 18, are illustrated. The trigger assembly 78 is a known GLOCK® trigger assembly, comprising the GLOCK® trigger mechanism housing 80 with ejector, and the GLOCK® trigger 82 with trigger bar. The trigger assembly 78 further includes a GLOCK® connector and a GLOCK® trigger spring. Equivalents of these components can of course be utilized. Further details of the trigger assembly 78 are shown in U.S. Pat. No. 4,539,889 issued Sep. 10, 1985 which is hereby incorporated by reference herein as if fully set forth in its entirety.

Figure 6A:
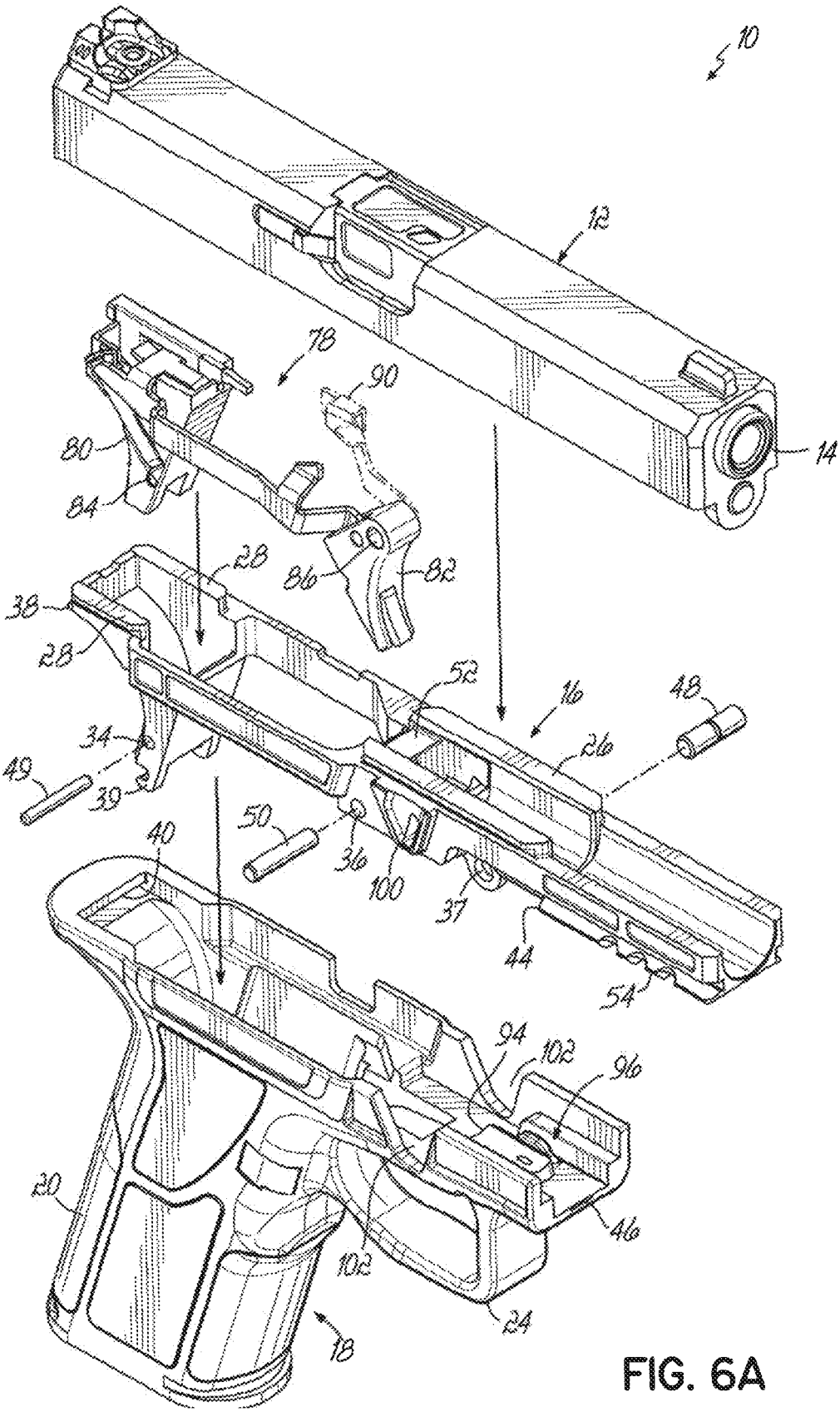
FIG. 6A is an exploded perspective view of a handgun grip frame, trigger frame, trigger assembly, and slide and barrel assembly according to one embodiment of the present invention.
Figure 6B:
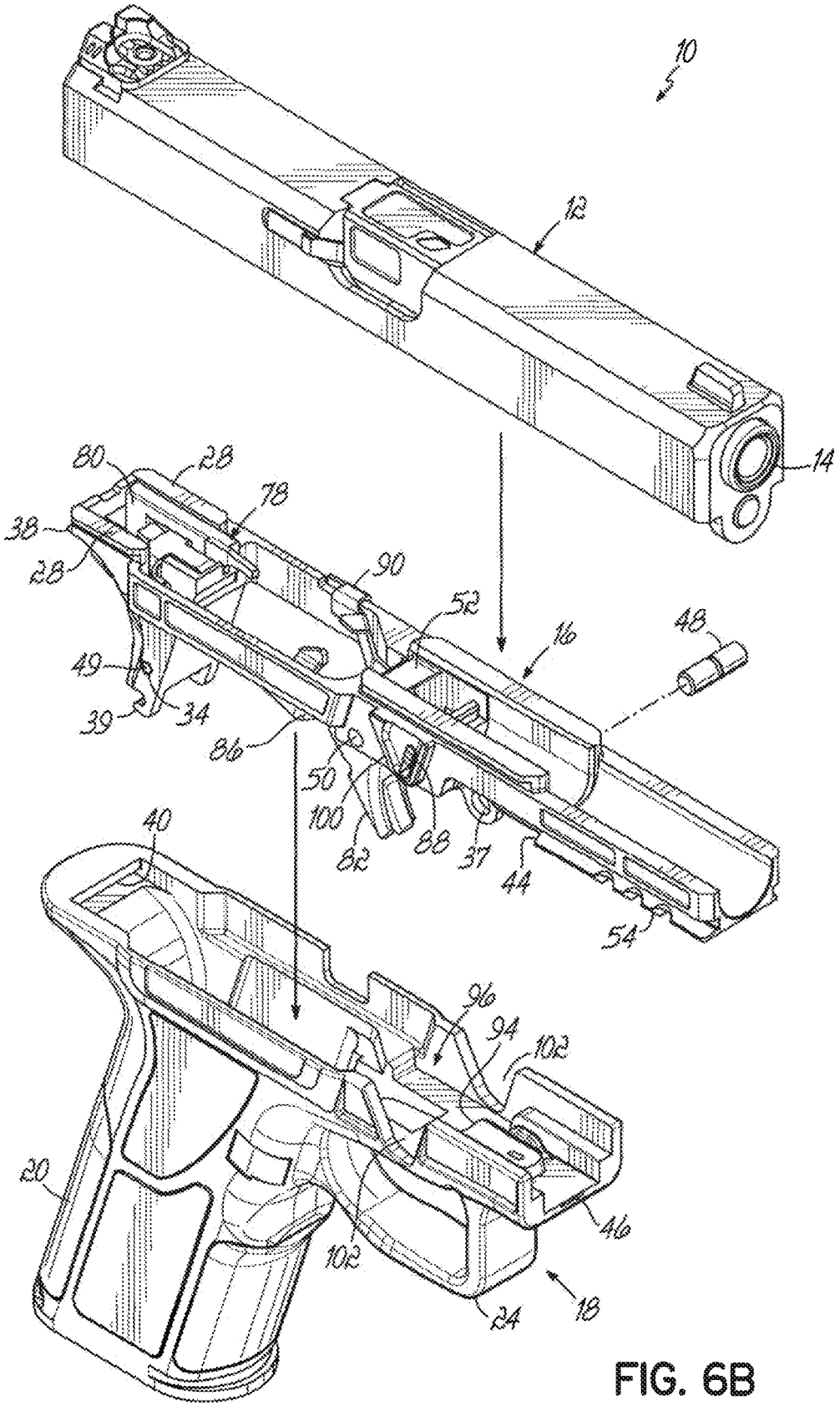
FIG. 6B is a view similar to FIG. 6A but with the trigger assembly installed in the trigger frame.

Referring first to FIGS. 6A and 6B, trigger mechanism housing 80 and trigger 82 are positioned in trigger frame 16. Opening(s) 34 in trigger frame 16 and opening(s) 84 in trigger mechanism housing 80 are aligned, and opening(s) 36 in trigger frame 16 and opening(s) 86 in trigger 82 are aligned. Trigger mechanism housing pin 49 is inserted through aligned openings 34 and 84, and trigger pin 50 is inserted through aligned openings 36 and 86. The GLOCK® slide lock lever or slide takedown lever 88, and the GLOCK® slide stop lever or slide release lever 90, can also be assembled to the trigger frame 16 at this point (FIG. 6B). Equivalents of these components can of course be utilized. Further details of the slide lock lever/slide takedown lever 88 and the slide stop lever/slide release lever 90 are shown in U.S. Pat. No. 4,539,889.

Figure 6C:
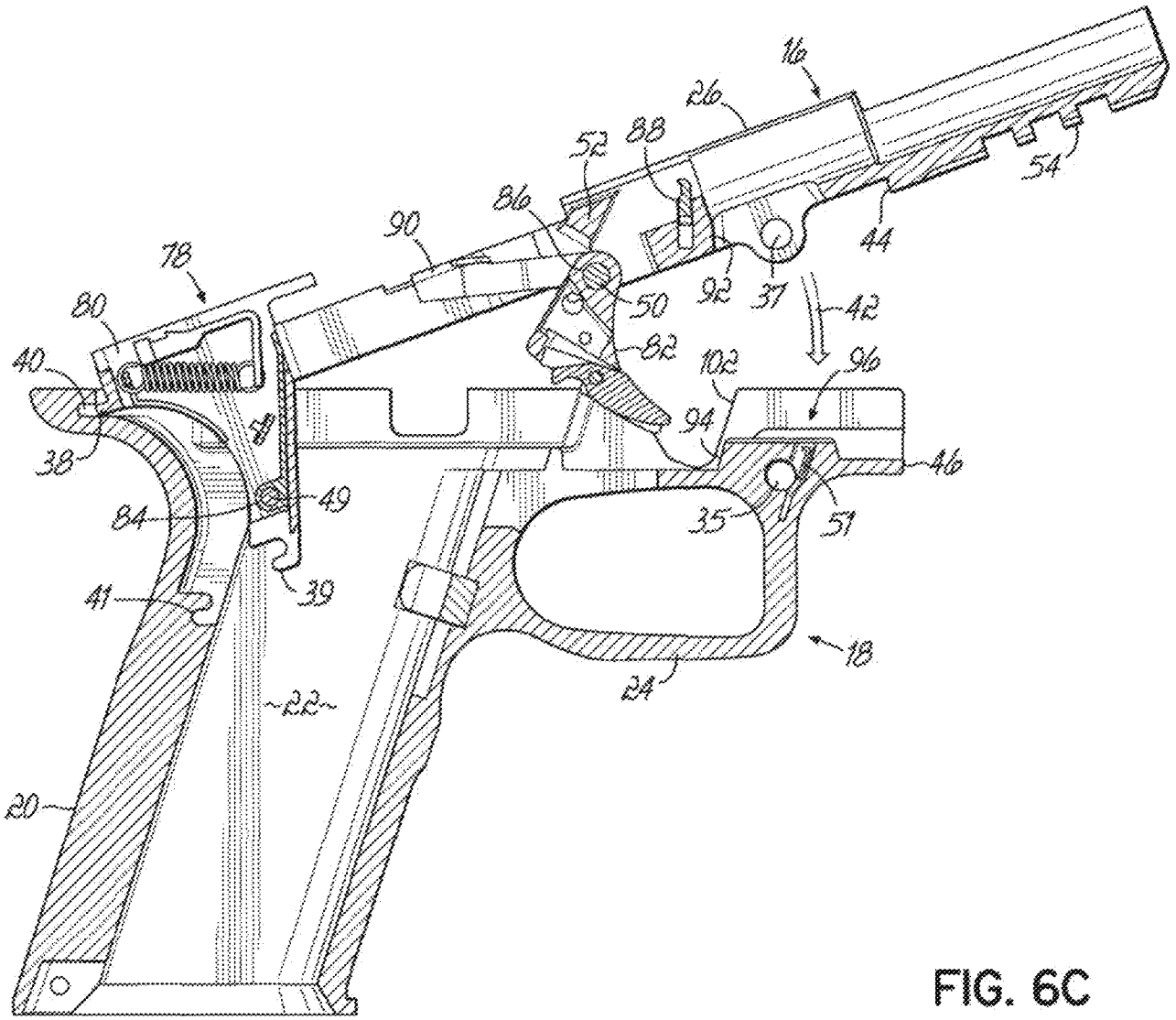
FIG. 6C is a side cross-sectional view illustrating the trigger frame partially assembled to the grip frame.
Figure 6D:
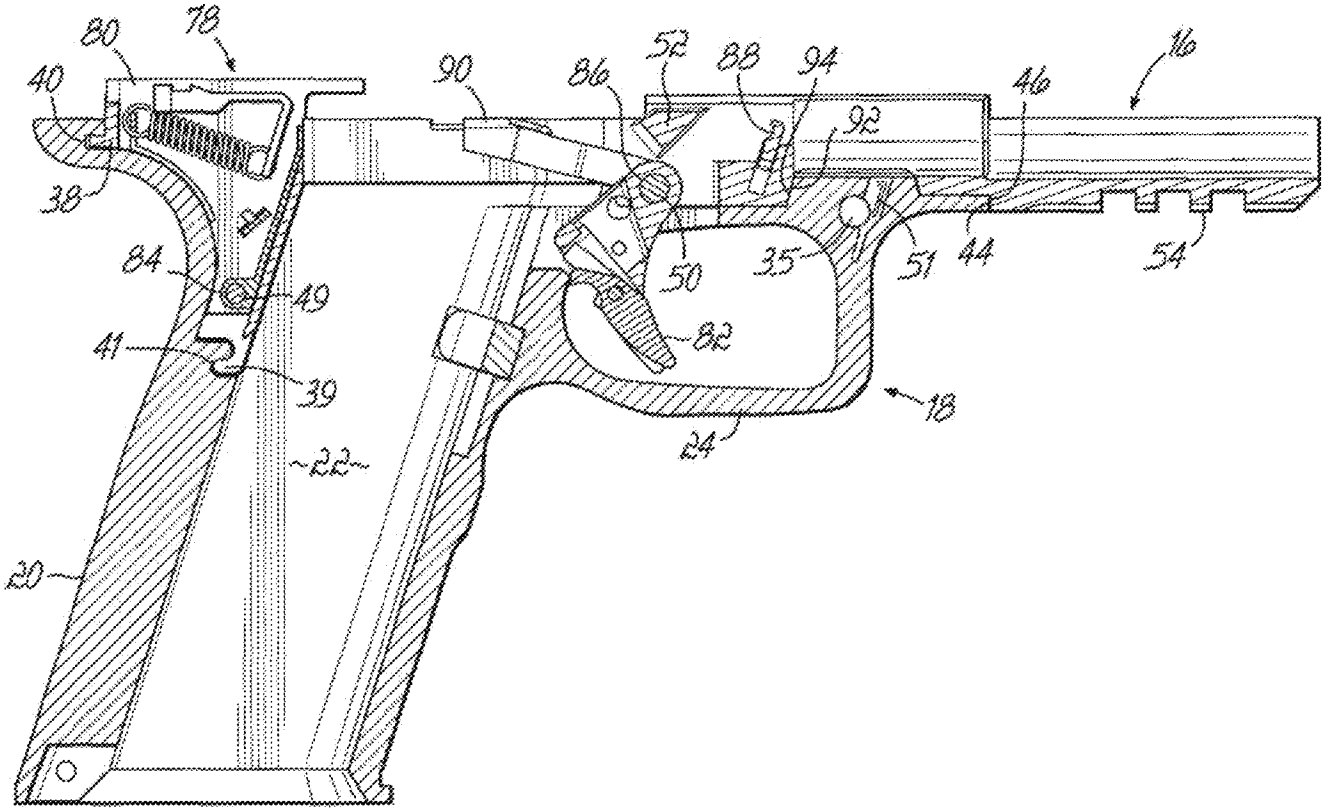
FIG. 6D is a view similar to FIG. 6C but illustrating the trigger frame fully assembled to the grip frame.

Referring now to FIGS. 6C and 6D, the trigger frame 16 may be snap-fit to the grip frame 18 by first inserting a tail extension 38 of the trigger frame 16 into a first rear socket 40 of the grip frame 18 while the trigger frame 16 is slightly upwardly angled relative to the grip frame 18 (as shown in FIG. 6C). After initial insertion of the tail extension 38 into the first socket 40, the trigger frame 16 may be pivoted toward the grip frame 18, as shown by arrow 42 in FIG. 6C, until lower hooks 39 engage a second socket 41 and a hook tooth 44 provided on the underside of the trigger frame 16 engages a hook edge 46 provided in the grip frame 18 forward of the trigger guard 24. The trigger frame 16 and grip frame 18 also have cooperating ramp surfaces 92 and 94, respectively. These cooperating ramp surfaces 92 and 94 cooperate to "cam" or "wedge" the trigger frame 16 rearwardly relative to the grip frame 18 after the extension 38 has been initially inserted into the socket 40 and as the trigger frame 16 is pivoted downwardly into the channel 96 of the grip frame 18, thereby serving to fully seat the trigger frame 16 rearwardly in the grip frame 18. To further secure the trigger frame 16 in the grip frame 18, the trigger frame 16 can have an outwardly extending V-shaped lug 100 on each lateral side thereof, and the channel 96 of the grip frame 18 can have a complimentary V-shaped notch 102 in each lateral side thereof, whereby each lug 100 is snugly received in a respective one of the notches 102 as the trigger frame 16 is pivoted downwardly into the channel 96 of the grip frame 18.

Figure 7:
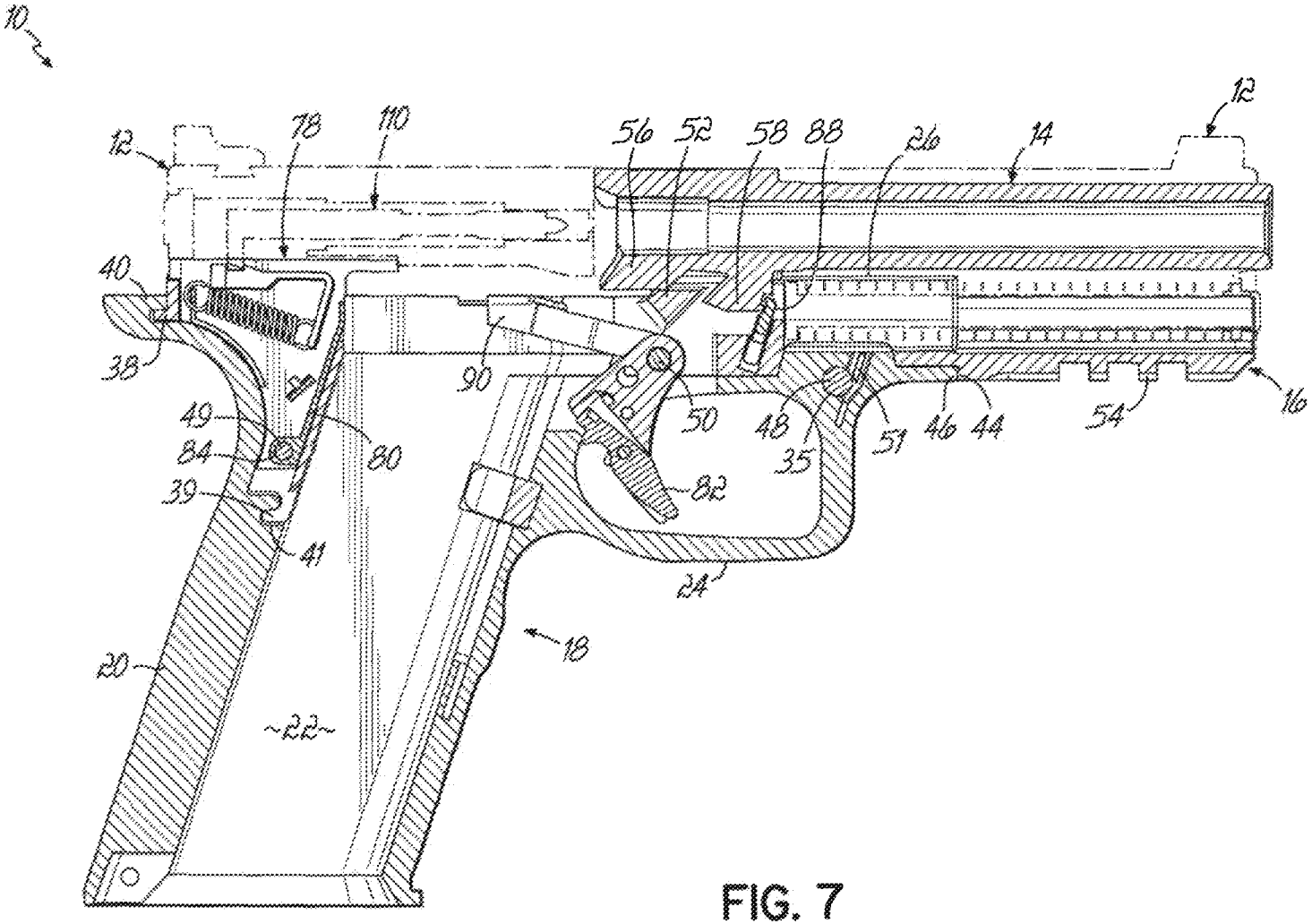
FIG. 7 is a view similar to FIG. 6D but illustrating the slide and barrel assembly installed on the trigger frame.
Figure 8:
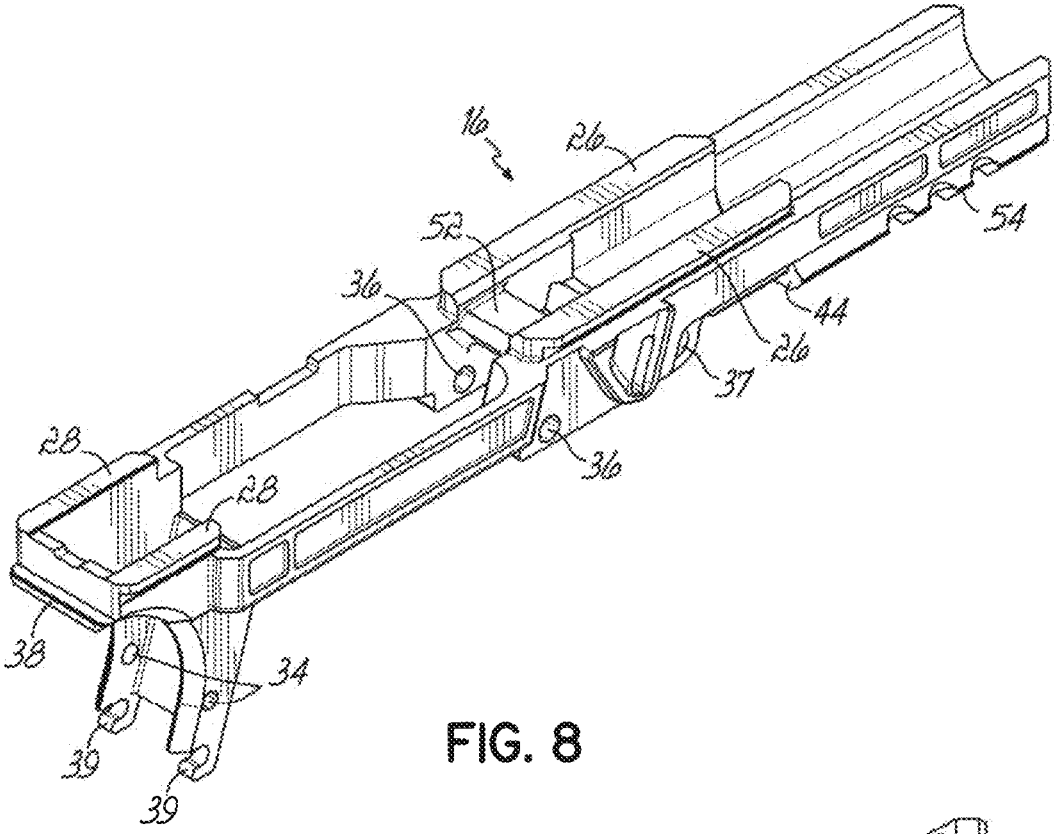
FIG. 8 is a rear, right, top perspective view of a trigger frame according to one embodiment of the present invention.
Figure 9:
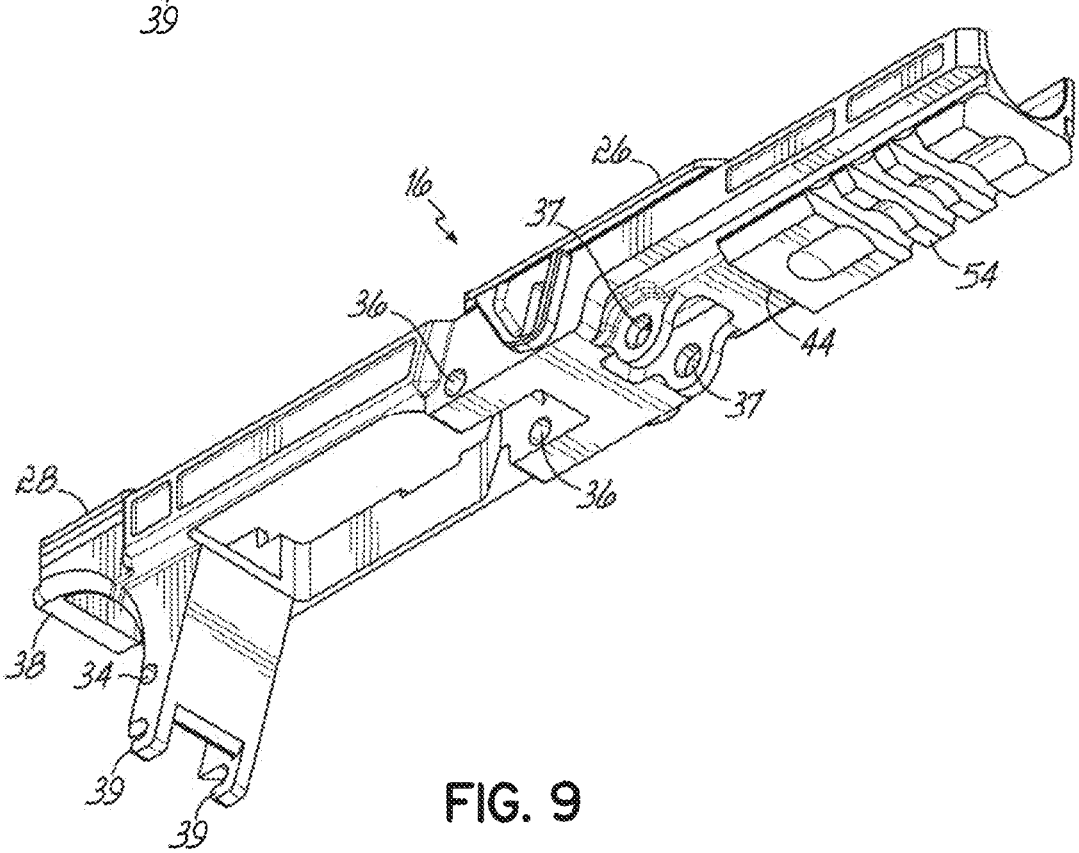
FIG. 9 is a front, right, bottom perspective view thereof.

This engagement provides a tool-less attachment of the trigger frame 16 to the grip frame 18 that assures proper alignment. After this initial assembly, further attachment can be provided by an assembly pin 48, as shown in FIG. 7. The assembly pin may be retained in place by a detent mechanism, such as engagement of a wire J-spring 51 with an annular groove provided at a mid-point on the assembly pin 48. The trigger frame 16 may be disengaged, if necessary, from the grip frame 18 by removing the assembly pin 48 and forcing the hook tooth 44 upwardly out of engagement with the hook edge 46. Because the trigger frame 16 is typically made of metal, such as steel or an aluminum alloy, and the grip frame 18 may typically be made from a fiber-reinforced polymer material, the difference in hardness between the two frames is typically sufficient to allow minor temporary flexing in the various contact areas of the trigger frame 16 to the grip frame 18 for forcing the trigger frame 16 and grip frame 18 into and out of engagement with one another. The points of engagement at the tail extension 38, lower hooks 39, hook tooth 44, ramp surface 92, and/or lugs 100 of the trigger frame 16, with the socket 40, socket 41, hook edge 46, ramp surface 94, and/or notches 102 of the grip frame 18, respectively, allow these two major components to be aligned and removably yet securely attached and detached without the use of tools.

Referring still to FIG. 7, once pin 48 has been inserted through aligned openings 35 and 37, the slide 12 and barrel 14 assembly is slid onto the rails 26 and 28 in a known manner. Shown diagramatically in the slide 12 is the known GLOCK® hammerless "striker-fired" firing mechanism 110 utilizing a spring loaded firing pin. Further details of the hammerless striker-fired firing mechanism 110, slide 12, and barrel 14 are shown in U.S. Pat. No. 4,539,889. It should be noted that the inventive trigger frame 16 of the present invention in all its various embodiments could also be utilized in handguns employing hammer-fired firing mechanisms.

According to another aspect of the present invention, and referring now in particular to FIG. 7, the trigger frame 16 may be configured to provide a more rigid, integral barrel locking feature. Modern semi-automatic handguns require a barrel locking mechanism to seal the breech face on the slide to the chamber of the barrel until pressures in the barrel from the gases propelling the bullet have dropped to a safe level. Unlike the barrel locking mechanism of other handguns, such as the GLOCK®, which may use a separate locking block member removably inserted into a polymer frame with an additional assembly pin, the present invention provides a locking block 52 that is formed as a cross-member between opposite sides of an elongated, unitary frame 16. Among other benefits, this construction maintains rigid and fixed dimensional relationships between other critical points of contact or movement between the slide 12 and frame 16 (such as at the slide rails 26), trigger pivot pin opening 36, trigger mechanism housing mounting pin opening 34, and accessory mounting rail 54 (to which aiming devices, such as a laser, may be mounted). Making the accessory rail 54 a part of the rigid frame 16, rather than as part of the polymer dust cover of the polymer grip frame extending from the trigger guard 24, allows mounted aiming devices to more accurately maintain alignment with the barrel 14.

Longitudinally spaced-apart, downwardly extending barrel lugs 56, 58 engage the locking block 52 during operation, allowing the barrel 14 to tip in a controlled manner as the slide 12 cycles. When in an in-battery position with the breech face of the slide engaged against the base of a cartridge (not shown) or a chamber of the barrel 14, the locking block 52 supports the barrel 14 firmly and precisely in place. As a result, frame 16 with the integral locking block 52 cross member provides a more rigid structure for supporting the barrel and maintaining accurate and consistent dimensioning between critical points. Accuracy is increased due to a reduction in the tolerance stacking that occurs when multiple parts are assembled together, particularly when the parts are separable and at least one structural component is made from a less rigid material. The integrated locking block 52 makes the handgun 10 easier to assemble and disassemble, having fewer parts.

The trigger frame 16 is preferably fabricated as a unitary integral metallic structure, with the barrel locking block 52, slide rails 26 and 28, and accessory rail 54 being formed integrally with the elongated frame portion of the trigger frame 16. The trigger frame could be fabricated as a casting, as a forging, by 3-d printing, by metal injection molding ("MIM"), or by being machined or milled from a single billet, as examples, and as mentioned above, could be fabricated of aluminum and alloys thereof or steel and alloys thereof, as examples.

Referring now to FIGS. 10-13, according to yet another aspect of the present invention, at least some of the surfaces at which the frame 16 engages the slide 12 for longitudinal reciprocation may include fullers or "blood grooves" in various form. Recessed areas on the contact surfaces between sliding parts allow clearance for excessive lubrication and/or debris under severe conditions, such as post-submersion under water or mud. Any potential particulate impediment to the slide's action can be freed as it is pushed away into these recesses. Further sliding motion can eventually discharge particulate debris from the recesses or channels into the outside environment or into larger interior cavities, providing a self-cleaning wiper mechanism. Moreover, the recesses can act as reservoirs for lubricant, which may be drawn onto the contact surfaces as adjacent moving parts slide over the edges of such recesses.

Figure 10:
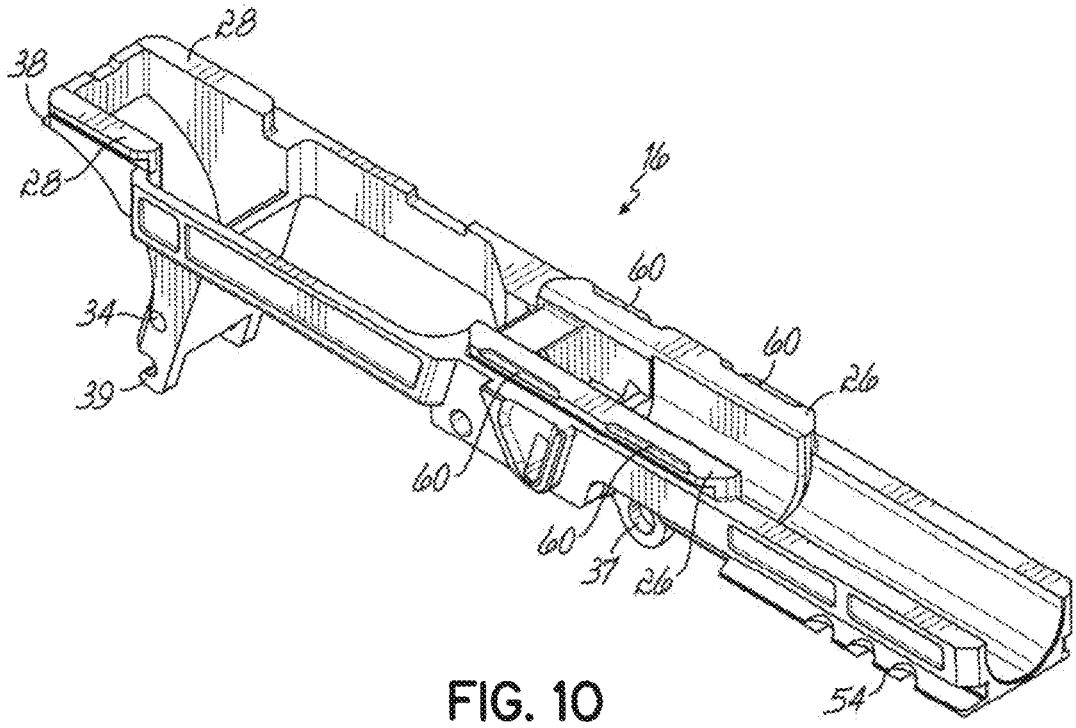
FIG. 10 is a view similar to FIG. 8 illustrating a second embodiment thereof.
Figure 11:
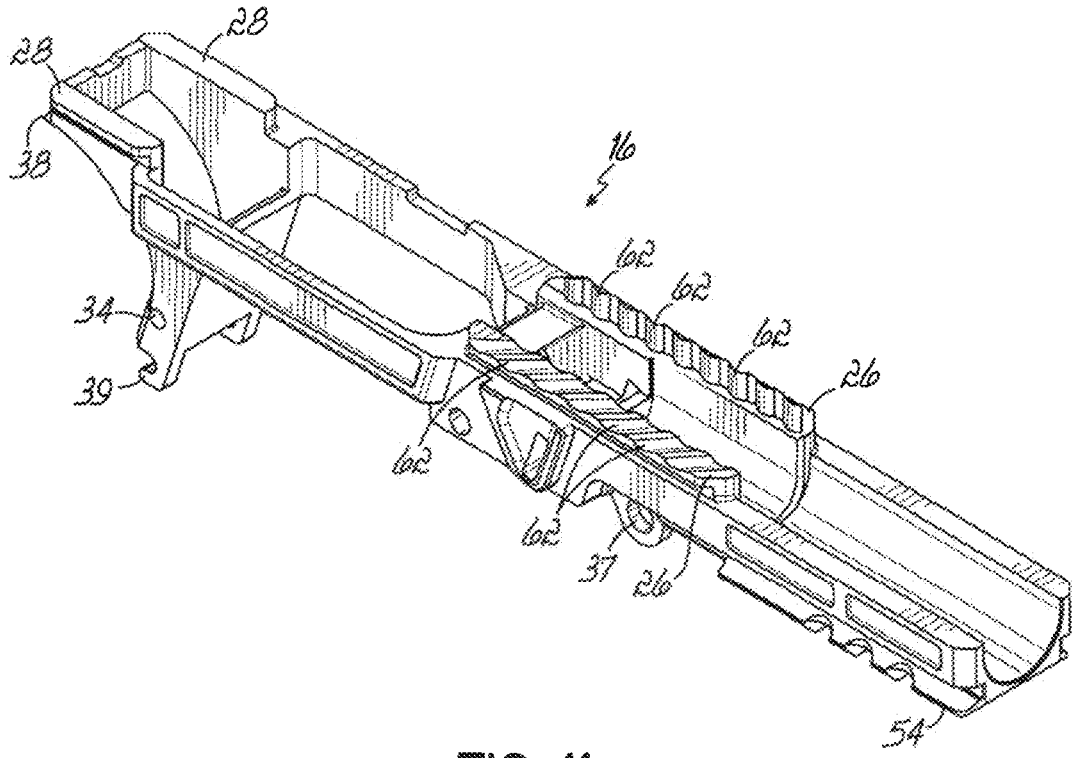
FIG. 11 is a view similar to FIG. 8 illustrating a third embodiment thereof.
Figure 12:
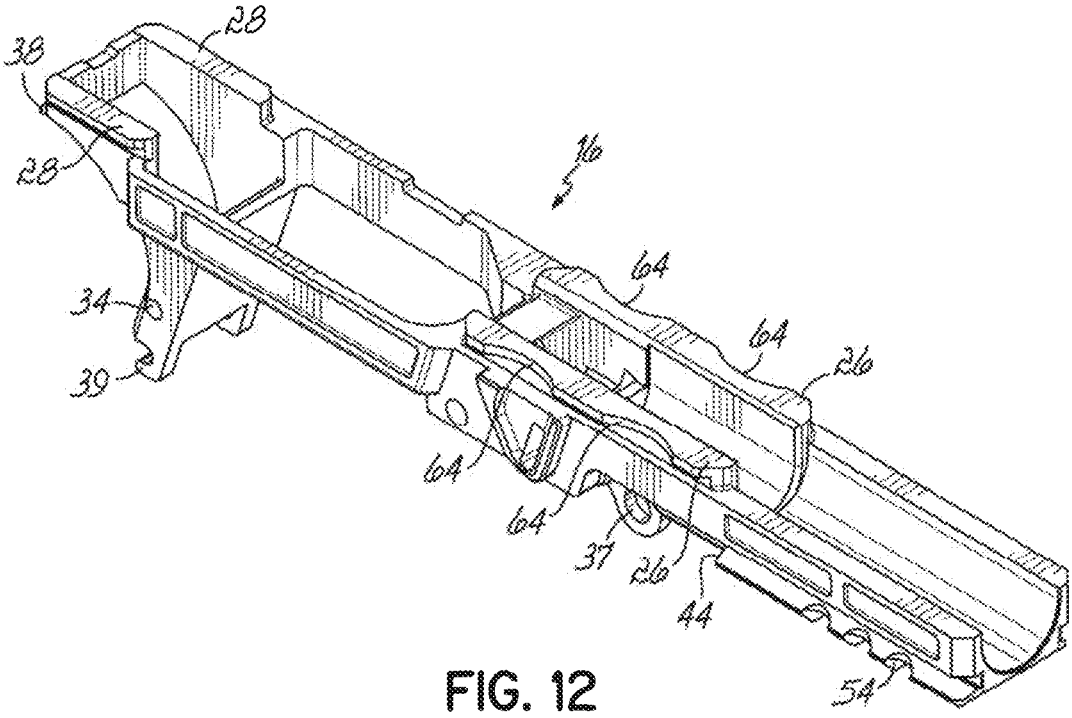
FIG. 12 is a view similar to FIG. 8 illustrating a fourth embodiment thereof.

FIG. 10 illustrates forward slide rails 26 in which fullers in the form of inlay recesses 60 are formed in the top surface and open to outboard sides thereof. FIG. 11 shows an embodiment of the frame 16 in which the forward slide rails 26 have upper surfaces into which a series of diagonal, parallel grooves 62 have been formed. FIG. 12 shows an embodiment in which the forward slide rails 26 have arcuate recesses 64 cut into the outboard surfaces (and upper surfaces) thereof. These features can be incorporated into the rear slide rails 28, as well.

Figure 13:
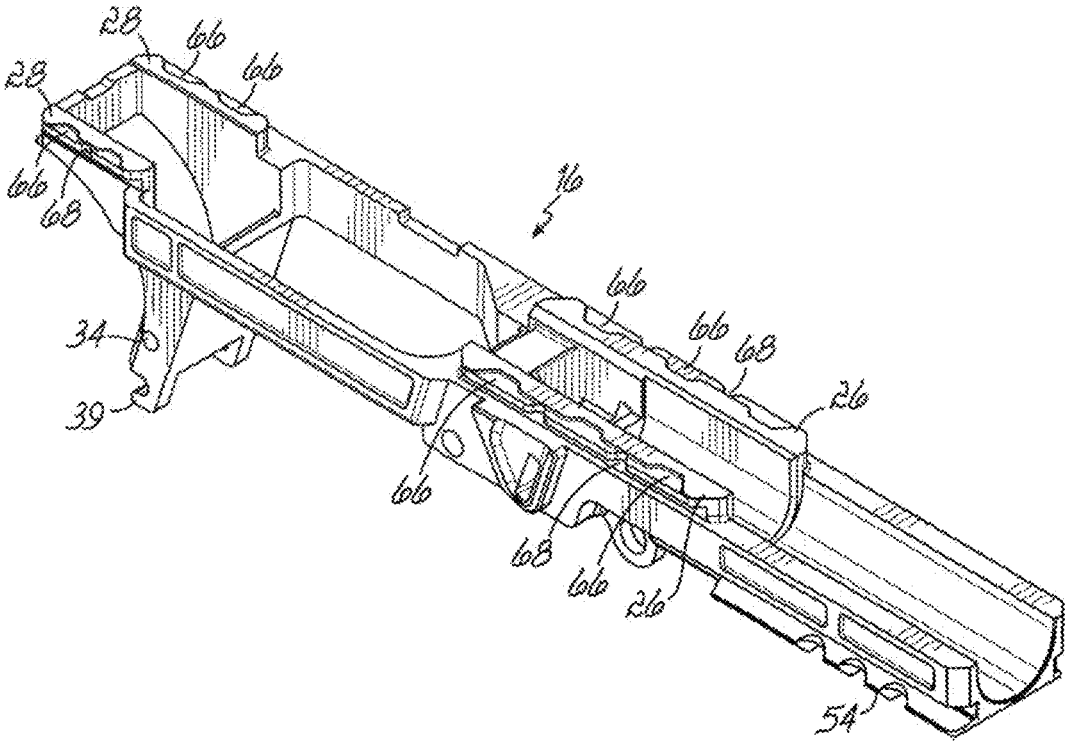
FIG. 13 is a view similar to FIG. 8 illustrating a fifth embodiment thereof.

FIG. 13 shows another embodiment using a combination of these features to include inlay recesses 66 and arcuate recesses 68 in both the forward slide rails 26 and rear slide rails 28.

Figure 14:
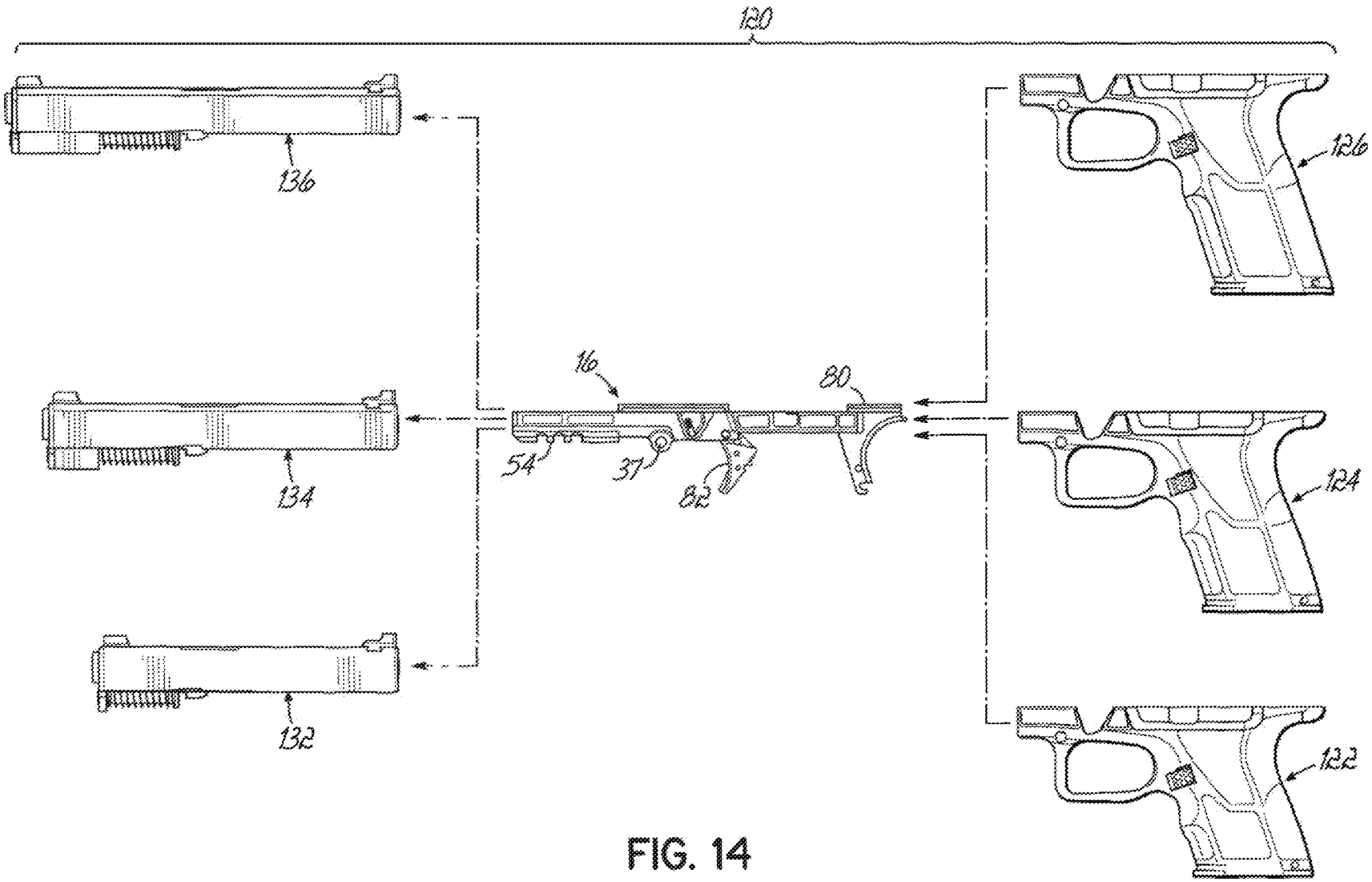
FIG. 14 is a side view illustrating a modular handgun system having a universal trigger frame, a plurality of grip frames, and a plurality of slide and barrel assemblies according to one embodiment of the present invention.

Referring now to FIG. 14, the inventive trigger frame 16 of the present invention readily lends itself to being utilized as a universal trigger frame or universal trigger module in a modular handgun system 120. As illustrated, the universal trigger frame 16 can be paired with one of a plurality of grip frames 122, 124, 126, each of which has a different hand grip length. The universal trigger frame 16 can likewise be paired with one of a plurality of slide and barrel assemblies 132, 134, 136, each of which has a different length. By way of example, the grip frame 122 could have a hand grip length similar to the GLOCK® 26 handgun, the grip frame 124 could have a hand grip length similar to the GLOCK® 19 handgun, and the grip frame 126 could have a hand grip length similar to the GLOCK® 17/34 handguns. Similarly, the slide and barrel assembly 132 could have a length similar to the GLOCK® 19 handgun, the slide and barrel assembly 134 could have a length similar to the GLOCK® 17 handgun, and the slide and barrel assembly 136 could have a length similar to the GLOCK® 34 handgun. Still further, additional grip frames could be provided having hand grip lengths of grip frames 122, 124, and 126 (or other hand grip lengths), but having different hand grip circumferences and/or being molded of different colors of polymer (e.g., black, gray, olive drab, flat dark earth, etc.). While the aforementioned handguns are 9 mm caliber, the invention lends itself to use with other calibers such as.357Sig, .40S&W, .45ACP, etc. And, a single universal trigger module of the present invention can be used with multiple calibers, simply by pairing the universal trigger module with the appropriate grip frame and slide/barrel assembly for a given caliber.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A modular handgun system comprising:

an elongated universal trigger frame having a pair of slide rails, said trigger frame adapted to have a trigger assembly mounted thereto;

a grip frame having an elongated channel, a hand grip extending downwardly from said elongated channel, and a trigger guard extending between said elongated channel and said hand grip, said trigger frame removably mounted in said elongated channel of said grip frame; and a slide and barrel assembly slidably mounted on said slide rails of said trigger frame;

wherein said trigger frame has an outwardly extending lug on each lateral side thereof and said elongated channel of said grip frame has a notch in each lateral side thereof, each said lug being received in a respective one of said notches.

2. The modular handgun system of claim 1, said trigger frame adapted to be used with a plurality of grip frames comprising the grip frame and with a plurality of slide and barrel assemblies comprising the slide and barrel assembly.

3. The modular handgun system of claim 2, wherein said trigger frame is adapted to be used with grip frames of the plurality of grip frames having a different hand grip length, a different hand grip circumference, or both, and wherein said trigger frame is adapted to be used with slide and barrel assemblies of the plurality of slide and barrel assemblies having a different slide and barrel length.

4. The modular handgun system of claim 2, the plurality of grip frames including at least two said grip frames and the plurality of slide and barrel assemblies including at least two said slide and barrel assemblies, one of said two grip frames having a first hand grip length and the other of said two grip frames having a second hand grip length, said second hand grip length being longer than said first hand grip length, and one of said two slide and barrel assemblies having a first slide and barrel length and the other of said two slide and barrel assemblies having a second slide and barrel length, said second slide and barrel length being longer than said first slide and barrel length.

5. The modular handgun system of claim 2, the plurality of grip frames including at least first, second, third, and fourth said grip frames and at least two said slide and barrel assemblies, said first grip frame having a first hand grip length and a first hand grip circumference, said second grip frame having a second hand grip length and a second hand grip circumference, said second hand grip length being longer than said first hand grip length, said third grip frame having a third hand grip length and a third hand grip circumference, said fourth grip frame having a fourth hand grip length and a fourth hand grip circumference, said fourth hand grip circumference being greater than said third hand grip circumference, one of said two slide and barrel assemblies having a first slide and barrel length and the other of said two slide and barrel assemblies having a second slide and barrel length, said second slide and barrel length being longer than said first slide and barrel length.

6. The modular handgun system of claim 1, wherein a rearward portion of said trigger frame has a first rearward extension, said grip frame has a first recess which receives said first rearward extension, said trigger frame and said grip frame have alignable openings, and further including a pin removably inserted in said alignable openings once aligned.

7. The modular handgun system of claim 6, wherein said rearward portion of said trigger frame further has a second rearward extension, and said grip frame has a second recess which receives said second rearward extension.

8. The modular handgun system of claim 7, wherein said second rearward extension comprises a pair of transversely spaced apart rearward hooks.

9. The modular handgun system of claim 6, wherein said trigger frame and said grip frame have cooperating ramp surfaces for camming said trigger frame rearwardly relative to said grip frame after said first rearward extension has been inserted into said first recess and as said trigger frame is pivoted downwardly into said elongated channel of said grip frame.

10. The modular handgun system of claim 1, wherein said trigger frame is adapted to have a slide release lever mounted thereto and a slide takedown lever mounted thereto.

11. The modular handgun system of claim 1, wherein said trigger frame is fabricated of a metallic material and said grip frame is fabricated of a polymer material, and wherein said trigger frame is a unitary structure with said pair of slide rails.

12. The modular handgun system of claim 1, wherein said trigger frame is machined from a single billet of metallic material.

13. The modular handgun system of claim 1, the elongated universal trigger frame including a pair of opposing sidewalls, said slide rails being positioned above respective surfaces of said opposing sidewalls.

14. A modular handgun system comprising:

an elongated universal trigger frame having a pair of slide rails, said trigger frame adapted to have a trigger assembly mounted thereto;

a grip frame having an elongated channel and a hand grip extending downwardly from said elongated channel, said trigger frame removably mounted in said elongated channel of said grip frame, and said trigger frame adapted to be used with a plurality of grip frames and with a plurality of slide and barrel assemblies, the plurality of grip frames comprising the grip frame; and a slide and barrel assembly slidably mounted on said slide rails of said trigger frame, the plurality of slide and barrel assemblies comprising the slide and barrel assembly;

wherein said trigger frame has an outwardly extending lug on each lateral side thereof and said elongated channel of said grip frame has a notch in each lateral side thereof, each said lug being received in a respective one of said notches.

15. The modular handgun system of claim 14, wherein said trigger frame is adapted to be used with grip frames of the plurality of grip frames having a different hand grip length, a different hand grip circumference, or both, and wherein said trigger frame is adapted to be used with slide and barrel assemblies of the plurality of slide and barrel assemblies having a different slide and barrel length.

16. The modular handgun system of claim 14, the plurality of grip frames including at least two said grip frames and the plurality of slide and barrel assemblies including at least two said slide and barrel assemblies, one of said two grip frames having a first hand grip length and the other of said two grip frames having a second hand grip length, said second hand grip length being longer than said first hand grip length, and one of said two slide and barrel assemblies having a first slide and barrel length and the other of said two slide and barrel assemblies having a second slide and barrel length, said second slide and barrel length being longer than said first slide and barrel length.

17. The modular handgun system of claim 14, wherein a rearward portion of said trigger frame has a first rearward extension, said grip frame has a first recess which receives said first rearward extension, said trigger frame and said grip frame have alignable openings, and further including a pin removably inserted in said alignable openings once aligned.

18. A modular handgun system comprising:

an elongated universal trigger frame having a pair of slide rails, said trigger frame adapted to have a trigger assembly mounted thereto, a rearward portion of said trigger frame having a first rearward extension;

a grip frame having an elongated channel and a hand grip extending downwardly from said elongated channel, said trigger frame removably mounted in said elongated channel of said grip frame, said grip frame having a first recess which receives said first rearward extension, and said trigger frame and said grip frame have alignable openings;

a pin removably inserted in said alignable openings once aligned; and a slide and barrel assembly slidably mounted on said slide rails of said trigger frame;

wherein said rearward portion of said trigger frame further has a second rearward extension, and said grip frame has a second recess which receives said second rearward extension.

19. The modular handgun system of claim 18, wherein said trigger frame and said grip frame have cooperating ramp surfaces for camming said trigger frame rearwardly relative to said grip frame after said first rearward extension has been inserted into said first recess and as said trigger frame is pivoted downwardly into said elongated channel of said grip frame.

20. The modular handgun system of claim 18, wherein said trigger frame has an outwardly extending lug on each lateral side thereof and said elongated channel of said grip frame has a notch in each lateral side thereof, each said lug being received in a respective one of said notches.

* * * * *